United States Patent [19]

Atkins et al.

[11] 4,056,841

[45] Nov. 1, 1977

[54] INDUCTIVELY COUPLED KEYABLE CONTROL CIRCUIT AND KEYING CIRCUIT THEREFORE USING HYBRID DETECTION MEANS

[75] Inventors: Carl E. Atkins, Montclair; Francis A. McGuirk, Jr., Chatham, both of N.J.

[73] Assignee: Wagner Electric Corporation, Parsippany, N.J.

[21] Appl. No.: 657,752

[22] Filed: Feb. 13, 1976

[51] Int. Cl.[2] ..... H01H 47/20; E05B 47/00

[52] U.S. Cl. ..... 361/203

[58] Field of Search ..... 307/10 AT; 317/134, 317/137, 146; 340/258 B, 258 C; 328/110; 361/171, 172, 191, 203

[56] References Cited

U.S. PATENT DOCUMENTS

| | | | |
|---|---|---|---|
| 3,597,636 | 8/1971 | Kravchenko | 328/110 X |
| 3,723,967 | 3/1973 | Atkins et al. | 317/146 X |
| 3,842,324 | 10/1974 | Atkins | 317/146 |

*Primary Examiner*—A. D. Pellinen

*Attorney, Agent, or Firm*—Eyre, Mann, Lucas & Just

[57] ABSTRACT

A keyable control circuit sequentially connects a widely swept fm rf signal to sensing coils at a plurality of detection locations. While rf energy is fed to one of the sensing coils, all other sensing coils are gated off. A resonant detector generates a first signal when an external keying circuit containing a tuned circuit, resonant at a correct first frequency, is inductively coupled to one of the sensing coils. A time-gated envelope detector generates a second signal when the external keying circuit contains a second tuned circuit resonant at a correct second frequency. When the first and second signals are simultaneously present, gating circuits generate a control output signal which may be used to unlock a door or perform other functions access to which is restricted to those possessing keys.

8 Claims, 5 Drawing Figures

FIG. 4
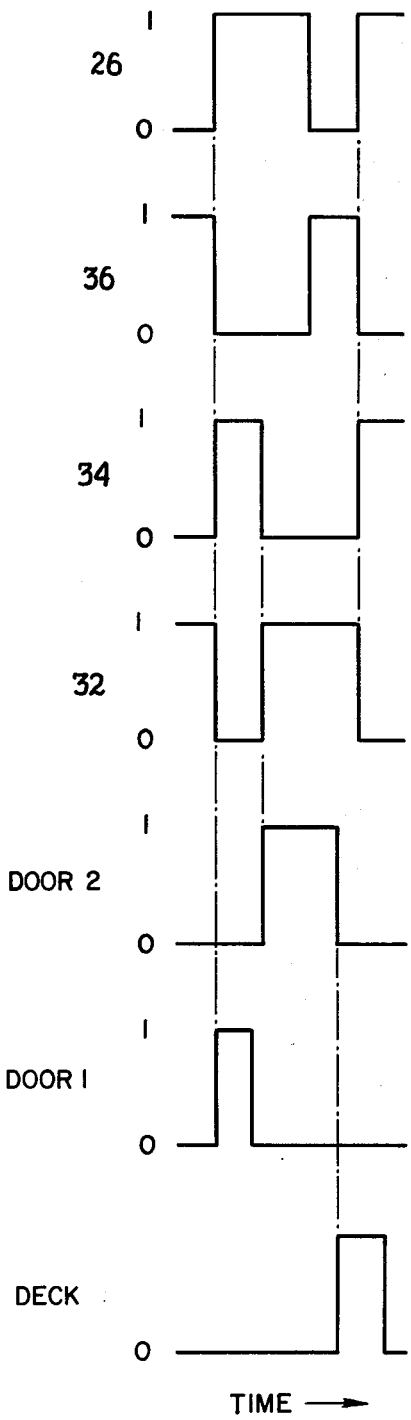
FIG. 2
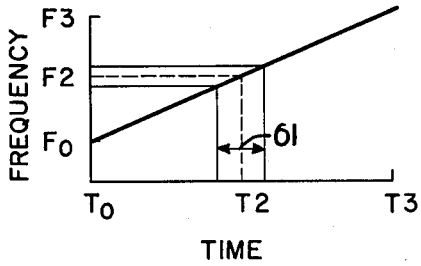
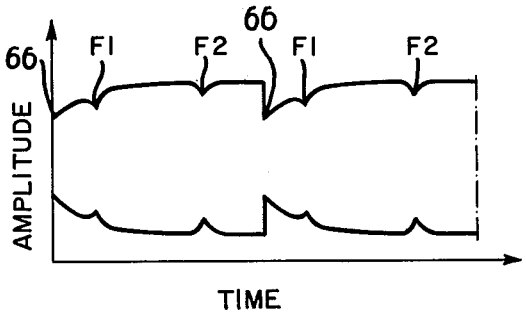
FIG. 5

INDUCTIVELY COUPLED KEYABLE CONTROL CIRCUIT AND KEYING CIRCUIT THEREFORE USING HYBRID DETECTION MEANS

BACKGROUND OF THE INVENTION

Inductively keyed control circuits utilizing rf energy coupled to a keying station accessible to an external keying circuit, have been disclosed in prior patents. For example, U.S. Pat. Nos. 3,723,967 and 3,842,324 disclose single-frequency systems depending on rf absorption in an external keying circuit to enable the generation of a control output signal. Co-pending patent applications Ser. Nos. 657,760, 652,465, 660,116 and 675,950 disclose the use of multiple keying frequencies. All of the previously disclosed systems make the sensing coil a significant part of the oscillator tank circuit. When implemented in this way, the provision for unlocking stations at a plurality of locations required to plurality of oscillators and/or associated detectors. In addition, prior swept-frequency devices required the use of a dead oscillator detector in order to avoid keying by a broadband absorber such as iron.

SUMMARY OF THE INVENTION

The instant invention contains a swept rf oscillator in which the frequency-determining components are essentially restricted to the swept oscillator tank circuit. A plurality of sensing coils, near locations where keyable control is desired, are connected one at a time to a sample of the swept rf energy in the swept oscillator tank circuit. All sensing coils not receiving rf energy at any instant are gated off by associated switches.

When an external keying circuit containing a plurality of tuned circuits resonant at a specific set of keying frequencies, is inductively coupled to one of the sensing coils, each time rf energy is connected to that sensing coil, resonant absorption of the swept rf energy occurs each time the frequency is swept past each of the specific keying frequencies.

Two different types of detectors sense the depletion of energy at the keying frequencies. One type of detector senses that a low level of rf energy exists at certain keying frequencies. The other type of detector senses that the evelope of the rf energy exhibits the type of change in amplitude produced by resonant absorption in the vicinity of certain keying frequencies. When both detector types successfully detect rf energy depletion at the same sensing coil, a control output is generated. Gating circuits direct the control output to a load associated with the particular sensing coil to which the keying circuit is coupled. The gating circuits prevent the connection of the control output to other than desired load.

The first type of detector contains a parallel-resonant circuit which receives a sample of the rf energy in the tank circuit. In the absence of a keying circuit, each time the rf frequency sweeps past the resonant frequency of the parallel-resonant circuit, the rf voltage across the parallel-resonant circuit is multipled by the Q of the parallel-resonant circuit at its resonant frequency. The presence of the resulting rf voltage spike is used to indicate the absence of a keying circuit. When a keying circuit, which absorbs rf energy at the same frequency as the parallel-resonant circuit, is coupled to the sensing coil, the depleted rf energy eliminates or reduces the magnitude of the rf voltage spike. The reduced rf voltage spike indicates the presence of the keying circuit.

The other type of detector detects the ac component of the rf envelope in the vicinity of a keying frequency. If the expected ac component is missing, as would be the case with rf absorbing material such as iron, this detector uses the absence of the ac component to indicate the absence of a keying circuit. Conversely, when the expected ac component is present at the proper time, the detector produces an enable signal.

BRIEF DESCRIPTION OF THE DRAWINGS

FIG. 2 shows a curve of time vs frequency of the swept rf signal.

FIG. 4 shows several timing and gating signals of the invention.

FIG. 5 shows an oscilloscope trace of the rf envelope in which resonant absorption at two keying frequencies is present.

DETAILED DESCRIPTION OF THE PREFERRED EMBODIMENT

Figure 1:
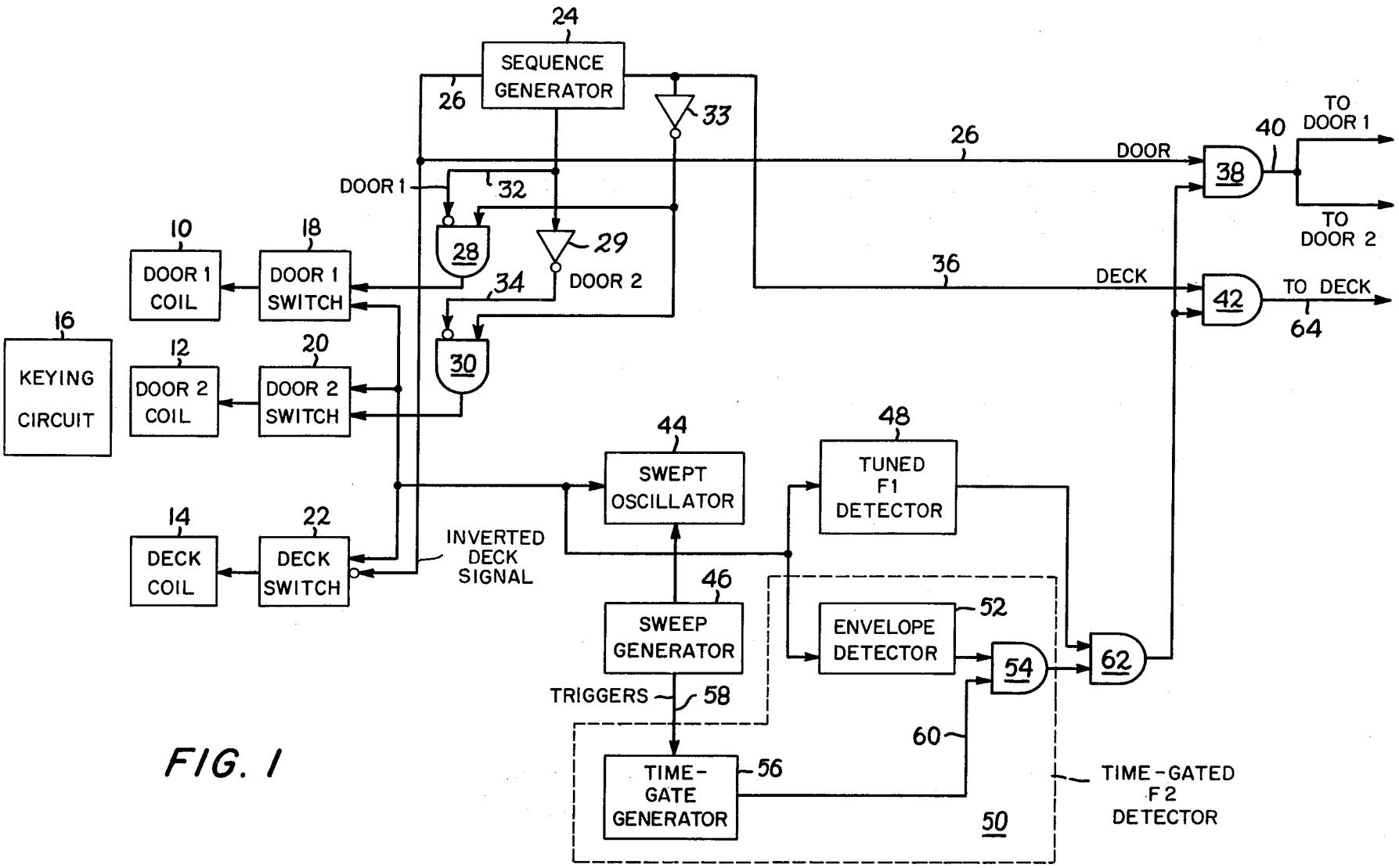
FIG. 1 shows a functional block diagram of one embodiment of the invention.

Referring to the block diagram shown in FIG. 1, three sensing coils, door 1 coil 10, door 2 coil 12, and deck coil 14 are disposed in locations which enable inductive coupling thereto by an external keying circuit 16. Each sensing coil 10, 12 and 14 is fed rf energy in turn by its respective switch 18, 20 and 22. Whenever any one sensing coil, door 1 coil 10 for example, is being fed rf energy through door 1 switch 18; then the other two switches, 20 and 22 in this example, isolate their respective sensing coils 12 and 14 from being fed rf energy. Coil switching in this manner eliminates the inductance and stray capacitance of the cutoff coils from the rf-generating circuits. The advantage of this will be later described.

The switches 18, 20 and 22 are turned on in sequence by a sequence generator 24. In this embodiment, it is desired to operate both door locks simultaneously whenever a correct keying signal is produced at either door sensing coil 10 or 12. Individual control of doors is also included within the scope of this invention.

For the description which follows, understanding may be enhanced by reference to the timing diagrams shown in FIG. 4.

The sequence generator 24 generates two pairs of mirror-image signals. The door-deck signals 26 and 36 are used to gate rf to door or deck sensing coils and to gate the control output to the correct load. The door 1 signal 32 is inverted in inverter 29 to produce the mirror-image door 2 signal 34.

The deck signal 36 is inverted in inverter 33 to produce a replica of the door signal 26 which is then connected in parallel to one input of door 1 AND gate 28 and door 2 AND gate 30. Inverter 33 provides extra isolation of the rf energy from the two door coils 10 and 12 during the deck sensing time. The door 1 and door 2 signals 32 and 34 are connected to inhibit inputs of their respective AND gates 28 and 30. During the door enable signal 26, the door 1 — door 2 signals go through an alternation which gates rf energy first to the door 1 coil 10, then to the door 2 coil 12. During this period, the door enable signal 26 connected to the inhibit input of the deck switch 22 ensures that rf remains cut off from the deck sensing coil 14. The door enable signal 26 is also connected to door output AND gate 38. If keying occurs at this time, the second input of door output AND gate 38 is enabled, in a manner which will be explained later. Door output AND gate 38 thereupon generates a door control output signal 40 which is connected to loads at the two doors (not shown). Deck output AND gate 42 remains inhibited at this time by the mirror image of the door enable signal 26 connected to one of its inputs. Thus a deck control output 64 is prevented during the door enable signal 26.

Similarly, when the door-deck signals 26, 36 reverse their condition, rf is cut off from the door sensing coils 10 and 12 by the inhibit signal now present at one input of AND gates 28 and 30. Rf energy is connected to the deck sensing coil 14 by the absence of the door enable signal 26 at the inhibit input of deck switch 22. Also, the deck enable signal 36 enables one input of deck output AND gate 42 which directs a deck control output 64 to the deck load (not shown) in the event of successful keying at this time. Door output AND gate 38 remains inhibited at this time.

A swept oscillator 44 has its rf output frequency swept over a wide frequency band by a sweep voltage signal connected to it from a sweep generator 46. The sweep voltage signal can be of any shape but is preferably a sawtooth waveform. The width of frequency sweep can be as wide as allowed by practical electronic components but is preferably 5 to 50 percent of the rf center frequency with best performance obtained in the neighborhood of 20 percent of the rf center frequency.

Two detectors of different types receive a sample of the rf energy in the swept oscillator 44. As the rf frequency is swept past each of the frequencies to which the external keying circuit 16 is resonant, the rf energy in the swept oscillator 44 is momentarily depleted. A tuned F1 detector 48 contains resonant circuits which allow an output signal to be generated only when energy depletion occurs at keying frequency F1. A time-gated F2 detector 50 performs non-resonant detection on the rf envelope in envelope detector 52. Envelope detector 52 provides an enable signal to time-gate AND gate 54 only during the instant during which energy depletion occurs. A time-gate generator 56, receiving trigger signals 58 indicating the instant a new frequency sweep begins, produces a narrow time-gate signal 60 a fixed time period later.

The frequency-time relationship of the rf frequency is shown in FIG. 2. From time $T_0$ to $T_3$, the rf frequency is swept through its frequency limits from $F_0$ to $F_3$. At some intermediate time $T_2$, the frequency F2 occurs. The time bracket 61 shown in FIG. 2 covers the time during which the rf frequency sweeps through F2. If the second resonant circuit in the external keying circuit 16 is tuned to frequency F2, the energy depletion occurs within time bracket 61. Thus the time-gate signal 60 to one input of time-gate AND gate 54 brackets the enable signal from the envelope detector 52 to the other input of the AND gate 54.

When both tuned F1 detector 48 and time-gated F2 detector 50 successfully detect energy depletion at their respective frequencies, they enable both inputs of coincidence AND gate 62. The resulting output of coincidence gate 62 enables one input of the two output AND gates 38 and 42. If either detector 48 or 50 fails to detect a signal at its respective frequency, coincidence AND gate 62 remains inhibited and prevents the generation of an output signal.

If the correct detection of the two-frequency signals is attained at the deck coil 14, for example, the output signal from coincidence AND gate 62 must occur during the deck enable signal 36 from the sequence generator 24. These two enable signals to the deck output AND gate 42 produce a deck control output signal 64 for connection to the load. Whenever the deck enable signal 36 is produced, an inhibit signal is connected from the sequence generator 24 to one input of the door output AND gate 38. Thus the generation of a door control output signal 40 is prevented when detection is accomplished at the desk coil 14.

Similarly, if correct detection occurs because of the presence of a keying circuit 16 at either door 1 coil 10 or door 2 coil 12, the output from coincidence AND gate 62 enabling one input of door output AND gate 38 coincides with the presence of the door enable signal 26 from the sequence generator 24 at the other input of the AND gate. Thus the door control output signal 40 is connected to the load at this time.

Figure 3:
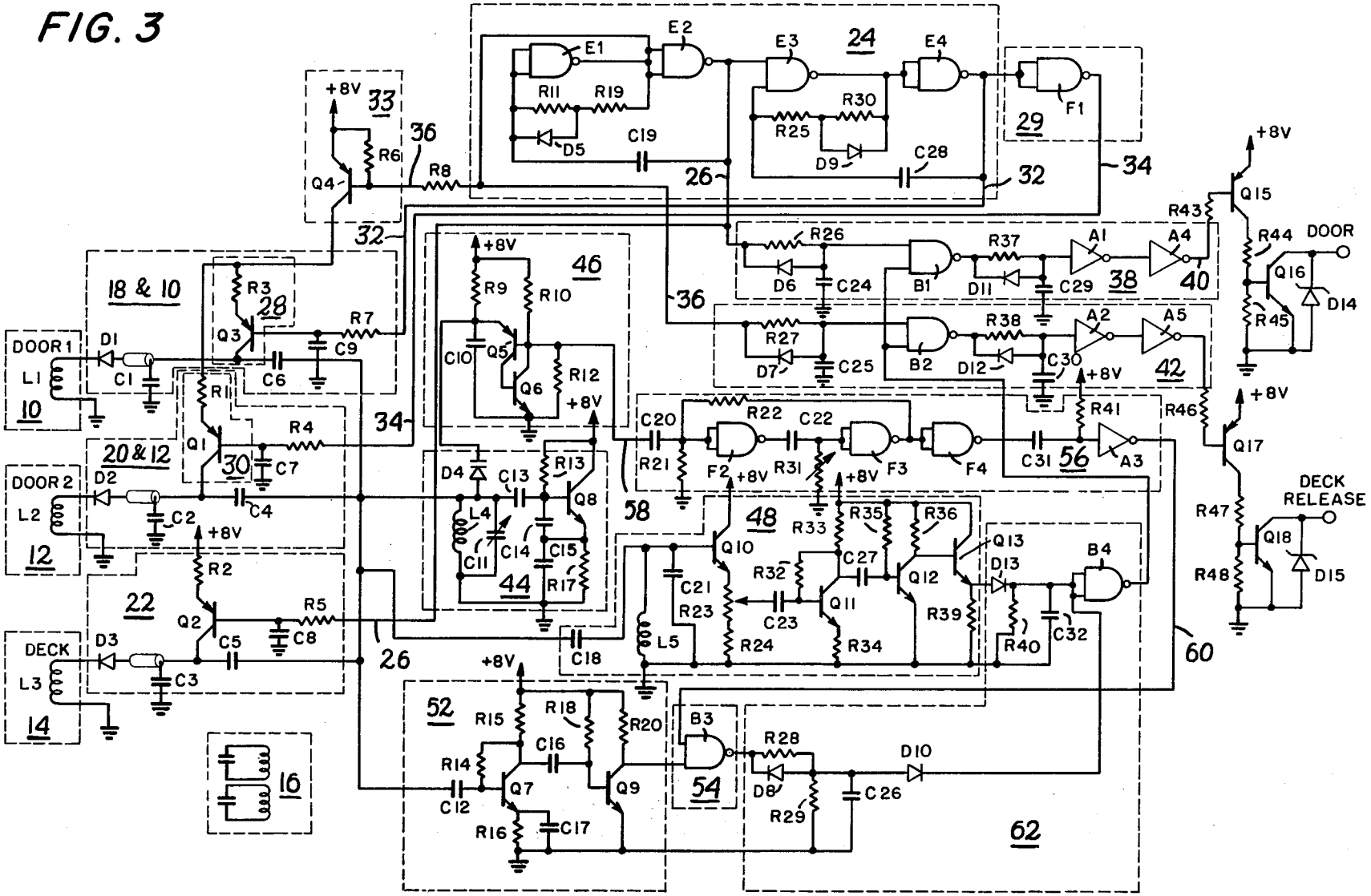
FIG. 3 contains a detailed schematic diagram of the embodiment shown in FIG. 1 wherein like functions are identified and identically numbered.

The following detailed description is with reference to the schematic diagram in FIG. 3 in which functions previously described are boxed and identically numbered.

The operation of deck switch 22 is similar to the operation of the door switches 18 and 20. Initially, switch transistor Q2 is cut off by the positive signal on door enable signal 26. Diode D3, having no forward bias, presents a high impedance to the swept rf signal connected to it by through coupling capacitor C5. When a zero occurs on door enable signal 26, switch transistor Q2 is turned on. The resulting forward current through diode D3 overcomes the high impedance of the diode junction. The rf energy, superimposed on the dc current through diode D3 is coupled to deck coil L3.

The operation of door switches 18 and 20 is similar to that just described for deck switch 22 except that the emitter supply to switch transistors Q3 and Q1 is controlled in parallel by inverter 33. This double switching for the door sensing coils enables more positive isolation than individual switching would provide. The joint operation of inverter 33 and the two switch transistors Q3 and Q1 performs the AND function of AND gates 28 and 30 shown in FIG. 1.

The swept oscillator 44 is a colpitts oscillator made up of transistor Q8 and related components. Positive feedback from emitter to base of Q8 is provided by the capacitive voltage divider consisting of C14 and C15. The oscillator tank circuit is made up of inductor L4 in parallel with capacitor C11. The junction capacitance of varactor diode D4 in series with sweep-generator capacitor C10 is in parallel with the tank circuit capacitor C11 and thus contributes to detemining the instantaneous operating frequency.

The sweep generator 46 contains capacitor C10 which charges approximately linearly toward the supply voltage through limiting resistor R9. Transistors Q5 and Q6 are initially cut off. The voltage at the base of Q5 is established at approximately 6.5 volts by the voltage divider consisting of R10 and R12. Until the voltage across C10 reaches 6.5 volts, the emitter-base junction of Q5 remains back biased. The cut off condition of Q5 ensures an open base lead to transistor Q6 and the consequent cutoff of Q6. When the voltage across C10 exceeds approximately 6.5 volts, the emitter-base junction of Q5 becomes forward biased. This provides a 6.5 volt signal through the emitter-collector junction of Q5 to the base of Q6. Q6 is thus turned on. Voltage divider resistor R12 is shunted by the emitter-collector junction of Q6. Thus the base of Q5 is clamped at approximately zero volts. Q5 and Q6 will remain turned on until the emitter voltage on Q5 drops to near zero volts. C10 is rapidly discharged through the emitter-collector junction of Q5 and the base-emitter junction of Q6. When C10 is sufficiently discharged, Q5 becomes cut off due to the back-biased condition of its emitter-base junction. Q6 is immediately cut off. The voltage at the base of Q5 agains rises to 6.5 volts thus establishing the initial conditions for another charging cycle of C10.

The cyclically varying voltage across C10 is imposed across varactor diode D4. The resulting variation in junction capacitance in D4 causes the frequency of swept oscillator 44 to sweep approximately linearly with time from its lower frequency limit to its upper frequency limit, then jump back to its lower frequency limit prior to the initiation of the next sweep.

The following paragraphs, describe the operation of time-gate generator 56.

When the switch transistors Q5 and Q6 in sweep generator 46 are turned on to initiate a new sweep cycle, the base of Q5 momentarily sees a very narrow negative-going pulse. This narrow pulse, coinciding with the start of a frequency sweep, is coupled through C20 to the one-shot composed of inverters F2 and F3 and related components. Inverter F3 puts on a negative-going, fixed duration pulse. The time after being triggered at which the pulse begins is set by variable resistor R31. Variable resistor R31 is adjusted to make the output occur at a time which brackets the occurrence of keying frequency F2. The output of inverter F3 is inverted in inverter F4, ac coupled by C31 to inverter A3. The output of inverter A3 is the positive-going time gate 60.

Sequence generator 24 contains two timers producing two pairs of outputs. The mirror-image door-deck outputs 26 and 36 are generated by inverters E1 and E2 with feedback components R11, R19, D5 and C19. The waveforms of outputs 26 and 36 are shown in FIG. 4. The mirror-image door 1 – door 2 outputs 32 and 34 are generated by AND gate E3 and inverters E4 and F1 with feedback components R25, R30, D9 and C28. The timing cycle of the door 1 – door 2 outputs 32 and 34 is initiated by the positive leading edge of the door-enable signal 26 connected to one input of AND gate E3. This ensures that a synchronous relationship is maintained between the door-deck outputs and the door 1 – door 2 output of the sequence generator. The resulting door 1 enable signal 32 and the door 2 enable signal 34 are shown in FIG. 4. In addition, the lower three curves in FIG. 4 show the time periods during which rf energy is connected to door 1, door 2 and deck sensing coils 10, 12 and 14.

A sample of the rf energy in the oscillator tank (FIG. 3) is coupled in parallel to tuned F1 detector 48 and enveloped detector 52. A reproduction of an oscilloscope trace of the rf envelope of a full first sweep and a portion of a second sweep are shown in FIG. 5. A new frequency sweep is initiated at point 66. In the initial portion of the frequency sweep, the envelope amplitude is relatively small due to the loading effect of the varactor diode on the oscillator output at lower frequencies. As the frequency is swept past keying frequencies F1 and F2 (not necessarily in that order), rf absorption at these frequencies in the external keying circuit (see FIG. 1) causes notches to appear in the rf envelope as the frequency sweeps past F1 and F2. It is the function of the detention circuits to recognize both that these notches occur and that they occur at the correct frequencies F1 and F2. The following description is written with reference to FIG. 3.

The tuned F1 detector 48 operates on the principle that, when a parallel-resonant circuit receives rf energy at its resonant frequency, the rf voltage appearing across it equals the applied rf voltage times the Q (quality factor) of the parallel-resonant circuit. If such an rf voltage pulse is sensed each rf sweep, the generation of an enable output is prevented. A sample of the swept rf energy in the swept oscillator 44 is coupled through C18 to the parallel-resonant circuit composed at L5 and C21. In the absence of a keying circuit 16 at the active sensing coil, each time the rf frequency is swept past the resonant frequency of L5 and C21, an rf voltage spike is coupled to the base of detector transistor Q10. Q10 allows only the positive half cycles of the rf input to appear at its emitter. The detected envelope is further amplified in Q11, Q12 and Q13 and connected as a sequence of positive-going pulses to coincidence AND gate 62. One positive pulse is produced each time the rf frequency sweeps past the resonant frequency of the parallel-resonant circuit L5–C21. Diode D13, feeds the detected positive pulses to capacitor C32. The time constant of capacitor C32 in parallel with resistor R40 is long compared to the rf sweep period. Thus capacitor C32 remains charged to approximately the peak of the detected pulse when it receives one pulse per frequency sweep. For example, a time constant of 35 milliseconds has been found useable with an rf sweep rate of 600 hertz. As long as capacitor C32 remains charged, coincidence AND gate 62 is prevented from generating an enable output.

When a keying circuit 16 containing a circuit resonant at frequency F1 is inductively coupled to a sensing coil, the F1 notch in the rf envelope seen in FIG. 5 coincides with the frequency at which L5 and C21 would otherwise produce an rf voltage pulse. Due to the depleted energy in the F1 notch, L5 and C21 produce an rf voltage pulse of much lower amplitude. The gain-control setting of R23 is established such that the reduced rf voltage pulse produces a negligible signal input to the amplifier chain Q11, Q12 and Q13. Thus the charge in capacitor C32 is allowed to dissipate through R40. When the voltage across C32 is sufficiently reduced, the first of the two conditions required for an enable output from coincidence AND gate 62 is achieved. The other required condition is described in the following paragraphs.

The time-gated F2 detector 50, composed of envelope detector 52, time-gate generator 56 and time-gate AND gate 54, operates on the principle that the F2 notch must occur at a given time with respect to the beginning of a frequency sweep. If such a notch is found to occur during the time period that F2 is supposed to occur, the second required input of coincidence AND gate 62 is produced as described in the following.

Q7 is a high-gain amplifier feeding detector Q9 through ac-coupling capacitor C16. Q9 is normally conducting. In the absence of an F2 notch, the constant low at the collector of Q9 inhibits one input of time-gate AND gate 54. The resulting constant high output of time-gate AND gate 54 charges capacitor C26 through limiting resistor R28. As long as capacitor C26 is charged, coincidence AND gate 62 is prevented from generating an enable output.

When a keying circuit 16 is coupled to the active sensing coil, Q9 receives the rf envelope containing the F2 notch. Q9 is momentarily shut off by the occurrence of the F2 notch. This causes the voltage at the collector of Q9 to rise to the supply voltage during its shut-off time. The resulting positive pulse is connected to one input of time-gate AND gate 54. The other input of time-gate AND gate 54 receives gate signals from time-gate generator 56. If the arrival time of the gate signal and the positive output of Q9 coincide, time-gate AND gate 54 produces a negative-going pulse output. The charge in capacitor C26 is rapidly discharged through forward-biased diode D8 during the negative-going output of time-gate AND gate 54. The charging time constant of C26 through R28 is too long to allow the accumulation of significant charge in C26 in the inter-pulse period. Thus C26 remains discharged during the inductive coupling of a keying circuit containing a circuit resonant at frequency F2 to the active sensing coil.

If both C32 and C26 reach the discharged state at the same time, the output of inverter B4, previously held low switches to high. The high output of inverter B4 is connected in parallel to one input of NAND gate B1 in door output AND gate 38 and NAND gate B2 in deck output AND gate 42.

The following description details the operation of deck output AND gate 42. The operation of door output AND gate 38 is similar to deck output AND gate 42 and its description is therefore omitted. Just prior to the occurrence of deck enable signal 36, input capacitor C25 is discharged. Also, capacitor C30 is fully charged by the high output of NAND gate B2. The output of inverter A5 remains high and thereby maintains Q17 in the cutoff condition. Lacking base bias output transistor Q18 remains cut off. The required ground path through the collector-emitter junction of Q18 is not available to energize the external door-control relay (not shown). Breakdown diode D15 is provided to protect the output transistor by bypassing the high-voltage pulse which results from the sudden cutoff of current to the external relay coil.

When the leading edge of the deck enable signal 36 occurs, the leading-edge delay circuit composed of capacitor C25 and limiting resistor R27 delays the application of the enable signal to NAND gate B2 for a short time. This short delay provides time for capacitor C32 and/or C26 to become charged before enabling the generation of a control output signal. In this way, if a door control signal was generated in the immediately preceding time period, the discharged condition of capacitors C32 and C26 at the instant of switchover to the deck channel, are prevented from generating a spurious deck control signal.

At the end of the initial delay, one input of NAND gate B2 is enabled by the deck enable signal 36. If proper detection at the two keying frequencies F1 and F2 is simultaneously received at coincidence AND gate 62, the output of coincidence AND gate 62 enables the second input of NAND gate B2. With both of its inputs enabled, the output of NAND gate B2 switches from high to low. The charge formerly stored in capacitor C30 rapidly discharges through forward-biased diode D12. The output of the inverter chain A2 and A5 switches from high to low. The resulting low input at the base of Q17 is correct to turn on Q17. The emitter-collector junction of Q17 provides a path for base-control voltage to output transistor Q18. Output transistor Q18 turns on and thereby provides a ground path for the energization of an external deck-lock control relay (not shown).

The following list of component values and identities have been found to give satisfactory performance in one embodiment reduced to practice.

Parts List

| Diodes | | Inductors | | Capacitors | |
|---|---|---|---|---|---|
| D1 | 2N4248 (C-B junction) | L1 | 10 uh | C1 | (stray circuit capacitance) |
| D2 | " | L2 | 10 uh | C2 | " |
| D3 | " | L3 | 10 uh | C3 | " |
| D4 | MV1401 | L4 | 1 uh | C4 | .001 |
| D5 | IN4148 | L5 | 5 uh | C5 | .001 |
| D6 | IN4148 | | | C6 | .001 |
| D7 | IN4148 | **Integrated Circuits** | | C7 | 100 pf |
| D8 | IN4148 | A1–A5 | CD4009AE | C8 | 100 pf |
| D9 | IN4148 | B1–B4 | CD4011AE | C9 | 100 pf |
| D10 | IN4148 | E1–E4 | CD4011AE | C10 | .0047 |
| D11 | IN4148 | F1–F4 | CD4011AE | C11 | variable |
| D12 | IN4148 | | | C12 | .001 |
| D13 | IN4148 | **Resistors** | | C13 | .01 |
| D14 | IN4754 | R1 | 1K | C14 | 470 pf |
| D15 | IN4754 | R2 | 1K | C15 | 100 pf |
| | | R3 | 1K | C16 | 20 pf |
| **Transistors** | | R4 | 56K | C17 | 100 pf |
| Q1 | CA3096E | R5 | 56K | C18 | 2 pf |
| Q2 | CA3096E | R6 | 3.3K | C19 | .040 |
| Q3 | CA3096E | R7 | 56K | C20 | 50 pf (silver mica) |
| Q4 | 2N4248 | R8 | 10K | C21 | 100 pf (silver mica) |
| Q5 | CA3096E | R9 | 150K | C22 | .0027 |
| Q6 | CA3096E | R10 | 2.2K | C23 | 100 pf (silver mica) |
| Q7 | CA3096E | R11 | 3.3M | C24 | .0015 |
| | | **Capacitors** | | **Resistors** | |
| Q8 | 2N5132 | C25 | .0015 | R12 | 10K |
| Q9 | CA3096E | C26 | .001 | R13 | 330K |
| Q10 | 2N5132 | C27 | .001 | R14 | 22K |
| Q11 | CA3096E | C28 | .007 | R15 | 220K |
| Q12 | CA3096E | C29 | .1 | R16 | 10K |
| Q13 | CA3096E | C30 | .1 | R17 | 10K |
| Q14 | 2N3569 | C31 | .01 | R18 | 4.7M |
| Q15 | 2N4248 | C32 | .0015 | R19 | 1M |
| Q16 | 2N3569 | | | R20 | 220K |
| Q17 | 2N4248 | | | R21 | 330K |
| Q18 | 2N3569 | | | R22 | 100K |
| | | | | R23 | 2.5K var |
| **Resistors** | | | | R24 | 4.7K |
| R36 | 220K | R47 | 1.5K | R25 | 2.5M |
| R37 | 5.6M | R48 | 10K | R26 | 22M |
| R38 | 5.6M | | | R27 | 22M |
| R39 | 49K | | | R28 | 3.9M |
| R40 | 22M | | | R29 | 22M |
| R41 | 3.3K | | | R30 | 1M |
| R42 | 10K | | | R31 | 1M var |
| R43 | 10K | | | R32 | 22M |
| R44 | 1.5K | | | R33 | 100K |
| R45 | 10K | | | R34 | 10K |
| R46 | 10K | | | R35 | 3.3M |

It will be understood that the claims are intended to cover all changes and modifications of the preferred embodiments of the invention, herein chosen for the purpose of illustration which do not constitute departures from the spirit and scope of the invention.

What is claimed is:

1. In an inductively coupled keying circuit for actuating at least one load of the type which includes a swept rf oscillator and an external keying circuit containing at least one resonant circuit having a resonant frequency within the rf swept range of said swept rf oscillator, the invention which comprises:

a. a plurality of sensing coils;

b. switch means for switching the rf energy in sequence to each one of said sensing coils, and for switching off all of the other sensing coils whenever any one coil is switched on;

c. first means for generating a first signal in response to rf absorption in said at least one resonant circuit;

d. second means for generating a second signal in response to rf absorption in said at least one resonant circuit; and e. means, operative in response to the simultaneous presence of said first and second signals for enabling a control output signal for actuating at least one load.

2. The apparatus of claim 1 further comprising means for gating said control output signal to a particular one of at least two loads which is associated with the particular one of said plurality of sensing coils which is gated on at any instant.

3. The apparatus of claim 1 wherein said switching means comprises:

a. a semiconductor diode in series with the rf energy between said rf oscillator and each of said plurality of sensing coil; and b. means for applying forward dc bias to said semiconductor diode whereby the diode impedance to the transmission of rf energy is reduced.

4. The apparatus of claim 1 wherein said first signal generating means comprises:

a. a resonant circuit which receives a sample of the rf energy in said switched-on sensing coil;

b. first detector means operative to generate a third signal each time said rf frequency sweeps past the resonant frequency of said resonant circuit; and c. second detector means, operative in response to said third signal, to generate said first signal.

5. The apparatus of claim 3 wherein said second signal generating means comprises:

a. an envelope detector which receives a sample of the rf energy in said switched-on sensing coil, said envelope detector being operative to produce a third signal in response to a change in amplitude of the rf envelope;

b. means for generating a time gate occurring at a predetermined time within each frequency sweep; and c. gating means operative to generate said second signal whenever said three signal from said envelope detector and said time gate means coincide.

6. The apparatus of claim 1 wherein said second signal generating means comprises:

a. an envelope detector which receives a sample of the rf energy in said switched-on sensing coil, said envelope detector being operative to produce a third signal in response to a change in amplitude of the rf envelope;

b. means for generating a time gate occuring at a predetermined time within each frequency sweep; and c. gating means operative to generate said second signal whenever said third signal from said envelope detector and said time gate means coincide.

7. In an inductively coupled keyable control circuit and keying circuit for actuating at least two loads of the type which includes a swept rf oscillator and an external keying circuit containing at least one resonant circuit having a resonant frequency within the rf sweep range of said swept rf oscillator, the invention which comprises:

a. a plurality of sensing coils;

b. a switch having open and closed conditions which switches rf energy in sequence to each one of said sensing coils, and switches off rf energy from all of the other sensing coils when any one coil is switches on;

c. a swept rf oscillator connected through said switch when in its closed condition to said one sensing coil;

d. a tuned detector operative to generate a first signal whenever rf absorption in said at least one resonant circuit occurs at the resonant frequency of said tuned detector;

e. an envelope detector operative to generate a second signal when rf absorption in said at least one resonant circuit occurs at a particular time in the sweep of said swept oscillator;

f. an AND gate receiving said first and second signals and operative upon the simultaneous occurrences of said first and second circuits to enable a control output signal; and g. output gating means operative to direct said control output to the particular one of at least two loads which is associated with the particular one of said sensing coils which is gated on the any instant.

8. An inductively coupled keyable control circuit and keying circuit controlling at least two loads comprising:

a. at least two sensing coils associated with different loads;

b. a swept rf oscillator;

c. means for switching the rf energy from said swept rf oscillator to at least a first of said sensing coils while isolating said rf energy from at least a second of said sensing coils;

d. an external keying circuit adapted to inductive coupling with any one of said sensing coils;

e. said external keying circuit containing at least two resonant circuits;

f. said at least two resonant circuits being resonant at different rf frequencies;

g. said different resonant frequencies all being within the rf sweep of said rf oscillator;

h. resonant rf detector means resonant at one of said different frequencies;

i. said resonant rf detector means being operative to generate a first signal when said external keying circuit is inductively coupled to one of said sensing coils;

j. non-resonant envelope detector means;

k. gating means operative to gate on said envelope detector means during a particular time in each sweep;

l. said gating means also being operative to gate off said envelope detector means during other times;

m. means in said envelope detector means to generate a second signal when an external keying circuit is inductively coupled to one of said sensing coils;

n. an AND gate operative to generate a third signal in response to the simultaneous presence of said first and second signals; and o. output gating means operative to connect said third signal to the particular one of said at least two loads associated with the particular one of said at least two sensing coils to which said external keying circuit is inductively coupled.

* * * * *

UNITED STATES PATENT AND TRADEMARK OFFICE

CERTIFICATE OF CORRECTION

PATENT NO. : 4,056,841

DATED : November 1, 1977

INVENTOR(S) : Carl E. Atkins and Francis A. McGuirk, Jr.

It is certified that error appears in the above-identified patent and that said Letters Patent are hereby corrected as shown below:

Column 1, line 19, "to" should read --a--.

Column 5, line 27, "on" should read --out--.

Column 8, line 60, "swept" (first occurrence) should read --sweep--.

Signed and Sealed this

Second Day of May 1978

[SEAL]

Attest:

RUTH C. MASON
Attesting Officer

LUTRELLE F. PARKER
Acting Commissioner of Patents and Trademarks